United States Patent [19]

Lockwood

[11] Patent Number: 4,732,282

[45] Date of Patent: Mar. 22, 1988

[54] GRAVITY FEED DISPENSER AND METHOD

[76] Inventor: John D. Lockwood, 1431 Westgate Ave., Los Angeles, Calif. 90025

[21] Appl. No.: 76,780

[22] Filed: Jul. 23, 1987

[51] Int. Cl.[4] ..... A47F 1/00

[52] U.S. Cl. ..... 211/59.2; 312/45

[58] Field of Search ..... 211/59.2, 59.3, 106, 211/74, 181; 312/45, 72

[56] References Cited

U.S. PATENT DOCUMENTS

| | | | |
|---|---|---|---|
| 2,176,384 | 10/1939 | Varney | 211/59.2 |
| 2,239,369 | 4/1941 | Nauert | 211/59.2 X |
| 2,289,751 | 7/1942 | Brenholt | 211/59.2 |
| 4,205,763 | 6/1980 | Merl | 211/59.2 X |
| 4,401,221 | 8/1983 | Suttles | 211/59.2 |
| 4,479,583 | 10/1984 | Franklin et al. | 211/59.2 |
| 4,566,596 | 1/1986 | Hennig | 211/59.2 |

*Primary Examiner*—Robert W. Gibson, Jr.
*Attorney, Agent, or Firm*—Keith D. Beecher

[57] ABSTRACT

A gravity feed method and apparatus for displaying, dispensing and storing a variety of merchandise items. The apparatus has no moving parts. It includes a tripper which causes each item to turn automatically into a display position, when a previous item is removed. The dispenser also includes a convenient storage area which feeds each item to a display position by the force of gravity, when one of the items is removed. As each item is removed, it is replaced sequentially by succeeding items until the supply is exhausted. The apparatus in the described embodiment incorporates openings of specific size for loading items into the dispenser from either the front or rear. The apparatus may be made of wire, plastic, paper or sheet metal, and it may be constructed to accommodate a variety of items of different sizes. The apparatus may also be constructed to display the items at any desired angle. The apparatus, moreover, may be constructed so that it may be removably mounted on a shelf, or it may be constructed for rear mounting onto a wall or upright support, or it may be free standing. The apparatus is constructed to be used as a single unit or in multiple groupings.

12 Claims, 7 Drawing Figures

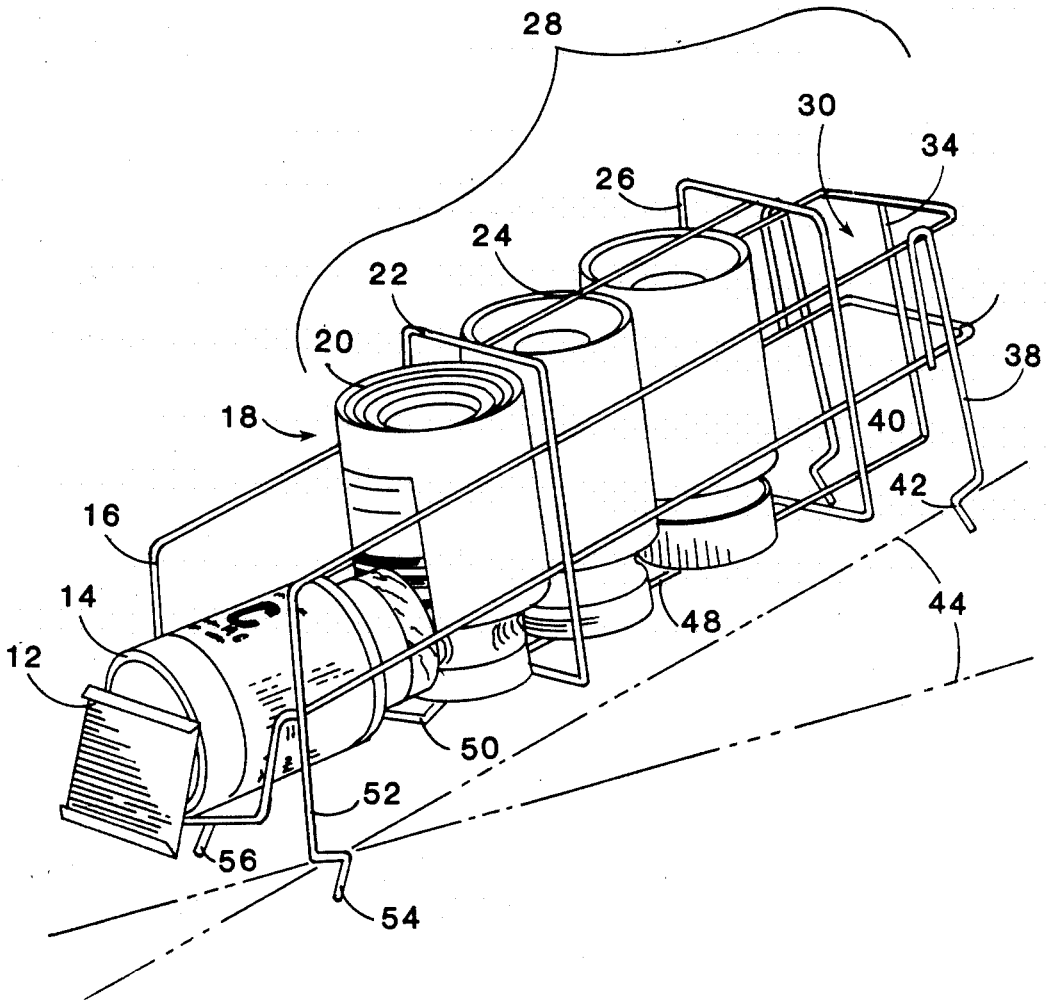
FIG #1

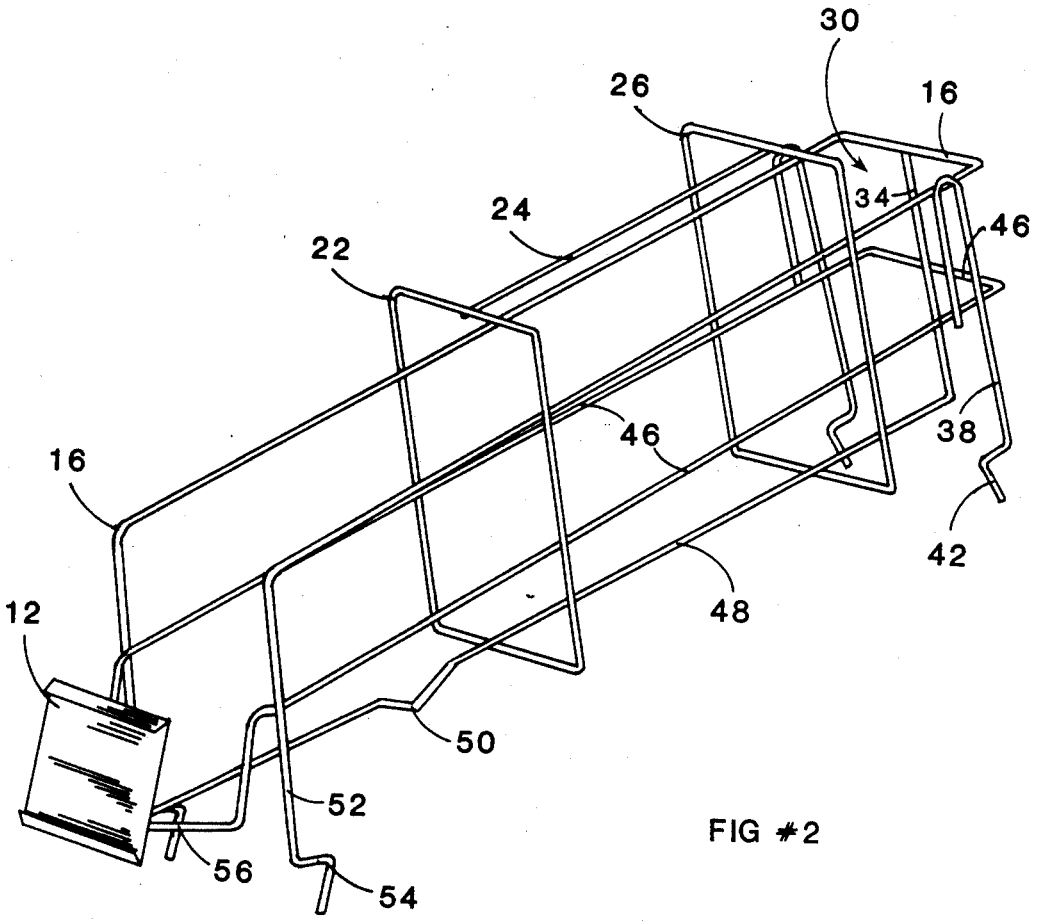
FIG #2

GRAVITY FEED DISPENSER AND METHOD

BACKGROUND OF THE INVENTION

It is usual in the prior art for merchanise in retail stores, for example, to be placed on shelves in rows, which rapidly become disorganized as the merchandise is progressively removed by customers. Attempts have been made to incline the shelves and in the retail stores, to install wire partitions to separate items so that the items may slide down the shelves by gravity in an orderly manner as they are removed. The problem in such a design is that in order to achieve an angle of inclination steep enough so as to function properly, standard shelves cannot be used, and special shelves must be made. Moreover, the merchandise dispensed by such a gravity feed system can only be viewed conveniently at eye level or above, in that the inclination of the label on the merchandise is always at somewhat of a downward angle. Accordingly, the dispensing shelf in such a prior art system that is slightly, or substantially below eye level, requires the customer to lean, or stoop down, in order to see the label.

More complex dispensing systems which incorporate spring-biased mechanical followers, or the like, have also been proposed in the prior art. However, such prior art spring-actuated dispensers are difficult to reload, and they can create chaotic results if they should malfunction, in that all of the merchandise is then spilled out of the shelves at once. Also, there is a tendency for the prior art mechanically-actuated dispensers to be loaded improperly, so that they do not dispense the merchandise in a reliable manner. In addition such systems suffer from a disadvantage in that any device with moving parts is subject to breakage and malfunctioning.

Prior art dispensers have also been developed for the specific purpose of dispensing round bottles, and the like. Such prior art dispensers usually employ some means by which the bottles are caused to roll down a chute. However, there is no assurance in such dispensers that the labels of the displayed bottles will face forward and be readable.

Bins have also been utilized in the prior art for storing large quantities of small items. However, this method tends to be disorganized, and it makes it difficult for store personnel to count the stock for inventory purposes. Moreover, the disarrayed appearance of the merchandise in such bins is unattractive to the customer and encourages improper replacement of items.

An objective of the present invention is to provide an improved dispenser and method whose primary function is to bring remaining items forward on a shelf in a retail store, or the like, as each item is removed by a customer, thus eliminating the need for store personnel manually to move the items from time-to-time and bring them up into alignment with the front edge of the shelf, in order that they will not be hidden from view.

Another object of the invention is to provide such an improved dispenser and method in which each item is automatically oriented as it is brought to the front of a row of such items so that its label may be easily read by the customers.

The dispensers of the invention are intended to be installed in groups along the shelves of a merchandising facility in side-by-side relationship, and they are intended particularly to meet the requirements of the supermarket, or the like, where the customers help themselves, rather than being served by store personnel.

A further objective of the invention is to provide a convenient apparatus for storing items and for preventing unwanted mixing of items, with the apparatus having the capability of being factory-loaded and installed at the point of purchase.

Yet another object is to provide a dispenser which is constructed to promote organization on the shelf of the supermarket, and the like, and which may be constructed to fit each specific size of container of the various merchandise items, thus reducing the possibility of replacement of the product in an improper location, and promoting more efficient inventory counting.

A further objective of the invention is to provide a dispenser which is capable of rotating stock automatically, in that the dispenser may either be left in place, or very readily removed from the shelf or support, so that merchandise may be loaded into the rear of the dispenser producing a desired "last in-last out" rotation of the stock. It is also possible in the embodiment to be described to load the dispenser from the front, if so desired.

Further advantages of the design of the invention are its ability to support items so that they cannot be dislodged, for example, when subject to earthquakes, or the like; its ability to align the various merchandise items in a row on a shelf in a manner such that the items may easily be seen by a standing customer, even if the merchandise is on the lowest shelf; and its ability to be attached to a pegboard, or other vertical support, in addition to being mounted on a shelf as mentioned above.

In general, the primary objective of the present invention is to provide the merchandising industry with a more efficient means for displaying and dispensing items to the best advantage, in that the items are always displayed at their optimum angle of view, with their labels visible, and they are available for easy access to the customer at no requirement for personnel time and effort.

BRIEF DESCRIPTION OF THE DRAWINGS

FIG. 1 is a perspective side view of a dispenser representing one embodiment of the invention, showing the dispenser in an unloaded condition;

FIG. 2 is a perspective side view of the embodiment of FIG. 1, showing the dispenser loaded with merchandise items, and showing how the items are typically positioned and oriented in the dispenser.

DETAILED DESCRIPTION OF THE ILLUSTRATED EMBODIMENT

Figure 3A:
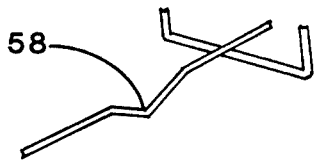
FIGS. 3A–3E are perspective views of alternate tripper mechanisms which may be incorporated into the dispenser of FIGS. 1 and 2.
Figure 3B:
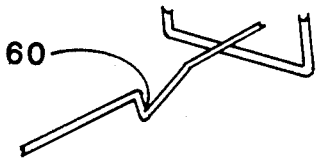

FIG. 1 is a perspective view of a dispenser representing one embodiment of the invention in an unloaded condition, and in which the dispenser is made out of wire. The dispenser comprises a horizontal wire 48 which provides a bottom support rail on which the merchandise items rest. In the illustrated embodiment, the merchandise items are bottles 28 (as shown in FIG. 2) which are placed upside down in the dispenser on their caps. Wire 48 is bent at bend 40 to a vertical position and welded to wires 16 and 48 to form the back of the dispenser.

Wires 16 and 46 are bent on a horizontal plane to the proper width to accommodate the bottles 28 with a tolerance, for example, of 0.2 cm on each side, and these wires then extend on both sides toward the front of the dispenser to provide upper and lower support rails. Wires 22 and 26 are placed, for example, 5 cm and 15 cm respectively from the vertical portion of wire 34, and they are bent to a rectangular form to provide front and rear support yokes. These yokes surround and touch wires 16 and 46 on both sides, the horizontal portion of wire 48 at the bottom and wire 24 at the top of the dispenser. Wire 24 performs a very important function, in that it acts as a top rail to prevent the items in the rack from tipping over prematurely. All joints are preferably welded, thus forming a wire frame to hold the bottles 28 (FIG. 2) with an oversize tolerance, for example, of 0.2 cm on all sides.

Wires 38 on each side of the rear end of the dispenser are bent 180° with a shorter portion being welded to wires 16 and 46, and with a longer portion protruding below the horizontal portion of the bottom support rail wire 48 approximately 1.5 cm. The protruding end of the longer portion of each wire 38 is bent into a proper configuration to provide a foot 42 which fits, for example, into rear receiver holes formed in the shelf on which the dispenser is mounted.

The configuration of each wire foot 42 is designed to latch into and support the dispenser on the shelf. The longer portion of each wire 38 forms a resilient spring to provide a horizontal spring-back movement capability of approximately 1 cm. This allows the dispenser to be moved back and forth until its forward feet are received in and engage forward receiver holes in the shelf.

Bottom support rail wire 48 continues forward towards the front of the dispenser, and it is indented, for example, 0.75 cm at a position designated 50 to form a tripper. The tripper is located approximately 10 cm, for example, from the front of the dispenser, depending upon the size of the merchandise item for which it is designed. Then wire 48 proceeds to the front of the dispenser, and it is bent vertically to fit the angle of a price tag molding 12. The wire 48 is welded to the back of the price tag molding 12.

Wires 16 and 46 extend forwardly on both sides towards the front of the dispenser. The upper wire 16 is bent downward at an angle of 85°, for example, approximately 4 cm from the front of the dispenser. Wire 16 crosses to the outside of wire 46, extends below wire 48 approximately 1.5 cm, for example, and it is bent to form one of the feet 54. Each foot 54 has a proper configuration to fit into the front receiver holes on the shelf.

Lower wire 46 is welded to the vertical portion of wire 16, and it is bent downward at a 90° angle, for example, approximately 3 cm from the front of the dispenser. Wire 46 is then bent horizontally when it is almost level with wire 48, and it is finally bent vertically to fit the angle of the price tag molding 12. Wire 48 is also welded to the back of the price tag molding.

FIGS. 1 and 2 show the embodiment of the invention as a practical dispensing mechanism for the merchandising industry. The embodiment of the dispenser shown in FIGS. 1 and 2 is made of wire as noted above. However, plastic, wood, paper or sheet metal could be used to advantage. The dispenser may be loaded with the desired items (here the example is vitamin bottles 28) from the front or from the rear, as explained above.

Items are loaded into the dispenser from the rear by placing them, one at a time, through the rear opening 30. In the embodiment of FIG. 2, each bottle 20 must be placed upside down, in an inverted position on its cap, with the label facing toward the rear of the dispenser. Each successive bottle 20 will slide forward on the support wire 48 toward the front of the dispenser, due to the force of gravity, because the dispenser is inclined approximately 14° with its rear end higher than the front. When the first bottle 20 reaches tripper 50, it is caused to topple forward and fall onto its side, with the label facing upwardly, into the receiver portion 56 at the front of the dispenser to become the display bottle 14. The receiver portion 56 is directly behind the price tag molding 12. The display bottle 14 is now ready for removal. When the display bottle is removed, the same action is repeated for the next bottle in the row.

The bottles may also be loaded into the front of the dispenser through opening 18. In that case the whole row of bottles 28, not including the display bottle 14, is pushed towards the rear by each successive bottle added from the front. With either the front or rear loading method, the frontmost display bottle 14 is always resting in the receiver 56 in a convenient approximately horizontal position, with its label facing upwardly to be readily visible. This positioning allows the customer to see the bottle and its label conveniently; to see the price of the specific bottle, due to its proximity to the price tag molding 12; and to remove the bottle easily, due to the bends in the forward portion of the dispenser 56.

The practical feature of this invention is that as each successive display bottle 14 is removed, the next bottle in the row falls naturally into place and, due to the loading of the bottles upside down with their labels facing backwards, the display bottle 14 is always resting at a convenient angle and its label is always facing upwardly.

The successive bottles in the row are held securely in place by a combination of two design features. Firstly, the dispensers are constructed for each specific bottle size, so that bottles cannot fall in any direction except forward. Secondly, forward motion of ensuing bottles 28 in the row is prevented by the display bottle 14 as it rests in the receiver 56 until it is removed.

The spring-back capability of wire 38 allows the whole dispenser unit to be conveniently engaged in the receiving holes in the shelf, and also to be readily removed for rear loading. The dispensers may be engaged into the receiving holes in a shelf; or a rear mounting design of the dispenser may be hooked into a wall, or wall bracket, or into an upright support.

Thus, it can be seen that the novel concept of loading the bottles 28 upside down with their labels facing the rear, in combination with the construction of the dispenser described above, causes the bottles to turn themselves automatically, with their labels facing upwardly, as they are tripped by the tripper 50. This solves a myriad of major problems for the merchandising industry. The items in the shelves are aligned automatically with the front of the shelf, because each dispenser always has the stored items fed foremost. The dispensers are simple to load and install, and they provide for automatic stock rotation. The bottle labels are always readable. The angled display increases the usefulness of the lower shelves. Moreover, the price is easily referenced to the items stored in the dispenser.

Figure 3C:
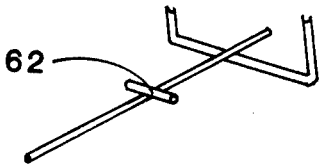
Figure 3D:
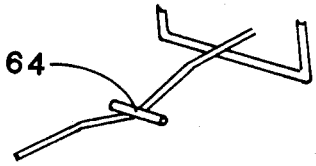
Figure 3E:
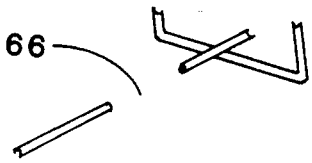

FIGS. 3A–3E show various types of trippers. For example, in FIGS. 3A and 3B, the trippers 40 and 42 are similar to the tripper 50 but represent notches of different angles. In FIGS. 3C and 3D, short transverse rods 44 and 46 are used to form the trippers. FIG. 3E, a space 48 is used to function as the tripper.

While a particular embodiment of the invention has been shown and described, this is not to be construed as a limitation on the scope of the invention, but rather as an example of one preferred embodiment. Those skilled in the art will envision that many other variations are possible within the scope and spirit of the invention.

For example, single dispensers may be used free-standing, or small groups of dispensers may be combined into a single unit. Dispensers may be made in colors to highlight new products, or different types of similar products. The dispensers may be constructed for large or small items, and may be customized to fit unusual item sizes. To avoid tampering the dispensers may be fitted with a simple mechanism to prevent replacement of an item once it has been removed. The design of the invention and the method of placing the items upside down and facing backward in the dispenser so that they may fall forward and upright automatically, is not limited in use to dispensing merchandise in retail outlets. For example, the dispenser may be used in factories or assembly line facilities.

Accordingly, the scope of the invention should be determined not by the illustrated embodiment, but by the appended claims and their legal equivalents.

I claim:

1. A gravity-feed dispensing apparatus comprising: a housing for supporting a row of items to be dispensed in an upright standing position, with an additional front item of the row being supported in a lateral lying position, and said housing including retaining means at the forward end thereof for holding the front item in the housing with the front item serving as a stop for the remaining items of the row, and said housing having an opening over the front item through which the front item is visible and enabling the front item to be removed; and a tripper mounted in said housing adjacent to the first upright standing item in the row to cause the first upright standing item to tip over and assume the lateral lying position of the first-named front item when the first-named front item is removed.

2. The gravity-feed dispensing apparatus defined in claim 1, in which the housing is formed of wire.

3. The gravity-feed dispensing apparatus defined in claim 1, in which the housing is dimensioned to hold items of a specific size.

4. The gravity-feed dispensing apparatus defined in claim 1, in which said housing defines a loading opening to the rear of the row of items.

5. The gravity-feed dispensing apparatus defined in claim 1, in which the housing defines a loading opening in the front of the row of items.

6. The gravity-feed dispensing apparatus defined in claim 2, and which includes a bottom rail, and in which said tripper is formed by a bend in the bottom rail.

7. The gravity-feed dispensing apparatus defined in claim 2, and which includes a bottom rail, and in which said tripper is formed by a transverse rod attached to the bottom rail.

8. The gravity-feed dispensing apparatus defined in claim 2, in which said housing includes wires forming rear and front legs to be received in holes in a shelf supporting the housing.

9. The gravity-feed dispensing apparatus defined in claim 8, in which one set of the rear and front legs are resilient to permit back and forth movement of the apparatus on the shelf.

10. A method for dispensing items which comprises: providing an inclined ramp for the items; placing the items in a row on the ramp in an upright standing position; placing one of the items in front of the row in a lateral lying position to hold the row of items on the ramp; and causing the front upright standing item in the row to tip over into a lateral position when the first-named lateral item is removed.

11. The method defined in claim 10, in which the upstanding items are placed upside down on the ramp.

12. The method defined in claim 11, in which the items are labelled and the upright standing items are placed on the ramp with their labels facing to the rear, and the label of the lateral lying item facing upwardly.

* * * * *